US010525363B2

(12) United States Patent
Gray

(10) Patent No.: US 10,525,363 B2
(45) Date of Patent: Jan. 7, 2020

(54) WATER SPRAYER FOR TRAMPOLINE JUMPING SURFACE

(71) Applicant: Eric Gray, Pahrump, NV (US)

(72) Inventor: Eric Gray, Pahrump, NV (US)

( * ) Notice: Subject to any disclaimer, the term of this patent is extended or adjusted under 35 U.S.C. 154(b) by 107 days.

(21) Appl. No.: 15/868,939

(22) Filed: Jan. 11, 2018

(65) Prior Publication Data

US 2018/0200634 A1 Jul. 19, 2018

Related U.S. Application Data

(60) Provisional application No. 62/447,017, filed on Jan. 17, 2017.

(51) Int. Cl.

| | |
|---|---|
| ***A63G 31/00*** | (2006.01) |
| ***A63B 5/11*** | (2006.01) |
| ***B05B 15/62*** | (2018.01) |
| *B05B 15/65* | (2018.01) |

(52) U.S. Cl.

CPC ..... *A63G 31/007* (2013.01); *A63B 5/11* (2013.01); *B05B 15/62* (2018.02); *A63B 2225/60* (2013.01); *B05B 15/65* (2018.02)

(58) Field of Classification Search

CPC ..... A63G 31/007; A63B 5/11; A63B 2225/60; B05B 15/62; B05B 15/65

USPC ..... 239/266–269, 273, 279, 289, 550, 556, 239/562

See application file for complete search history.

(56) References Cited

U.S. PATENT DOCUMENTS

| | | | | |
|---|---|---|---|---|
| 5,862,990 | A | 1/1999 | White | |
| 6,155,495 | A | 12/2000 | Jones | |
| 7,641,594 | B2 * | 1/2010 | Hickey | A63B 5/11 239/289 |
| 2005/0043122 | A1 | 2/2005 | Publicover et al. | |
| 2006/0160664 | A1 | 7/2006 | Lavabre | |
| 2007/0066447 | A1 * | 3/2007 | Overholt | A63B 5/11 482/27 |

* cited by examiner

*Primary Examiner* — Steven J Ganey
(74) *Attorney, Agent, or Firm* — Weide & Miller, Ltd.

(57) ABSTRACT

A trampoline water spraying system is provided and includes one or more sprayers configured to extend through the jumping surface of the trampoline, and tubing connecting the one or more sprayers to a water source. A sprayer for emitting water onto a trampoline is also provided. The sprayer includes a fitting configured to connect to tubing on a bottom side of a trampoline's jumping surface, and an emitter that extends through the jumping surface to emit water on a top side of the trampoline's jumping surface.

17 Claims, 5 Drawing Sheets

WATER SPRAYER FOR TRAMPOLINE JUMPING SURFACE

CROSS-REFERENCE TO RELATED APPLICATION

This application claims priority to U.S. Provisional Application No. 62/447,017 which was filed on Jan. 17, 2017, the contents of which are hereby incorporated by reference.

BACKGROUND

The disclosed embodiments relate to sprayers and methods for spraying water onto a trampoline jumping surface.

In hot climates, many enjoy cooling off in the water, such as at the beach, a waterpark, or in their own backyard. For example, children enjoy cooling off using a sprinkler attached to a garden hose or as part of an irrigation system. Those desiring also to jump on a trampoline during hot weather find it enjoyable to spray water onto the trampoline while jumping.

Typically, this is done by putting a sprinkler underneath the trampoline. However, this requires a strong sprinkler and most of the water emitted from the sprinkler simply bounces off the bottom side of the jumping surface, never being enjoyed by those on the trampoline. Another option is spraying water from the side of the trampoline onto the surface. However, this does not provide the same excitement as water coming from the surface on which users are jumping. Thus, an improved water sprayer for a trampoline is desired.

SUMMARY

According to one exemplary embodiment, a trampoline water spraying system is provided that includes one or more sprayers configured to extend through the jumping surface of the trampoline and tubing connecting the one or more sprayers to a water source.

In some embodiments where there are multiple sprayers, junctions are provided to connect the tubing to facilitate water flow to each of the plurality of sprayers. An inlet connection is connected to the tubing and attaches to a water source. In one example, the inlet connection is a female garden hose connector. A valve in the tubing may be disposed proximate to the inlet connection. The valve serves to control water flow through the tubing.

The sprayers may include a fitting with a tube connection end that connects the sprayers to the tubing adjacent to a bottom side of the jumping surface. An emitter may be disposed on a top side of the jumping surface. The emitter comprises a head and an elongated body that extends through a hole in the jumping surface and connects to an emitter connection end of the fitting.

The emitter connection end may have a diameter that is larger than the hole and prevents the sprayers from moving upwards toward the top side of the jumping surface. The emitter connection end may have an annular shape. In some instances, the emitter has a through hole extending centrally along the emitter.

In some embodiments, a spacer is disposed on the top side or a bottom side of the jumping surface below the head. An adhesive may also be provided to adhere the head to the top side of the jumping surface.

In another exemplary embodiment, a sprayer for emitting water onto a trampoline is provided. The sprayer includes a fitting configured to connect to tubing on a bottom side of a jumping surface of the trampoline and an emitter connected to the fitting that extends through the jumping surface of the trampoline to emit water on a top side of the trampoline.

The fitting may include a tube connection end connecting the sprayer to tubing adjacent to the bottom side of the jumping surface and an emitter connection end. The emitter comprises a head disposed on a top side of the jumping surface and an elongated body connecting to the emitter connection end through the hole in the jumping surface.

In other embodiments, the emitter connection end of the fitting is disposed proximate to the bottom side of the jumping surface. The emitter connection end has a diameter larger than the hole and prevents the sprayer from moving upwards toward the top side of the jumping surface. The emitter connection end may have an annular shape.

The emitter may comprise a through hole that extends centrally along the emitter. A spacer may be disposed below the head that is configured to rest on the top side of the jumping surface. An adhesive may be provided to adhere the head to the top side of the jumping surface. The fitting in some instances may be straight or may have an L-shape or other profiles.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
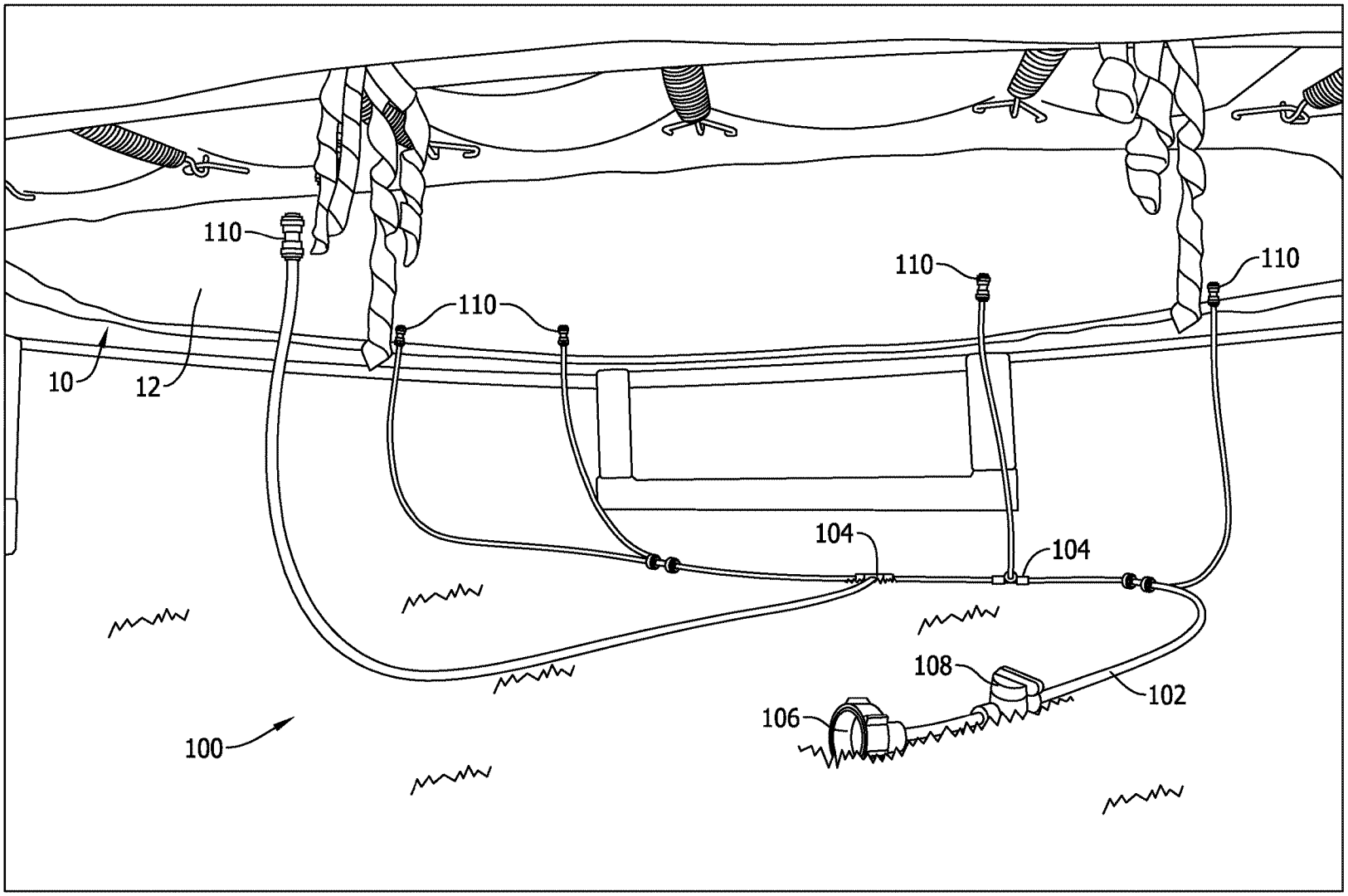
FIG. 1 shows water sprayers for a trampoline according to one exemplary embodiment.

FIG. 1 shows water sprayers for a trampoline according to one exemplary embodiment. In FIG. 1, there is a trampoline 10 with a jumping surface 12. A sprayer system 100 is provided for spraying water onto the trampoline jumping surface 12 so that jumpers playing on the jumping surface 12 may cool off and otherwise enjoy time playing and jumping on the jumping surface 12.

The sprayer system 100 may include tubing 102. The tubing transports water from a water source connected at an input connection 106 to sprayers 110 on the jumping surface 12 of the trampoline 10. The input connection 106 may be a standard female garden hose attachment that connects with a standard garden hose. Other types of connections now known or later developed may also be utilized.

A valve 108 may be provided near the input connection 106 to control the flow through the tubing 102. This allows control of the flow to be adjusted close to the sprayers 110 and the trampoline 10, to increase convenience. The tubing 102 directs the water from the input connection 106 to one or more sprayers 110 when the valve 108 is opened. The tubing may include one or more junctions 104 to distribute the water to multiple sprayers 110. The tubing 102 may be flexible tubing. For example, the tubing may be formed of any suitable material such as CPVC, PeX, PP, PBT, etc.

Figure 2:
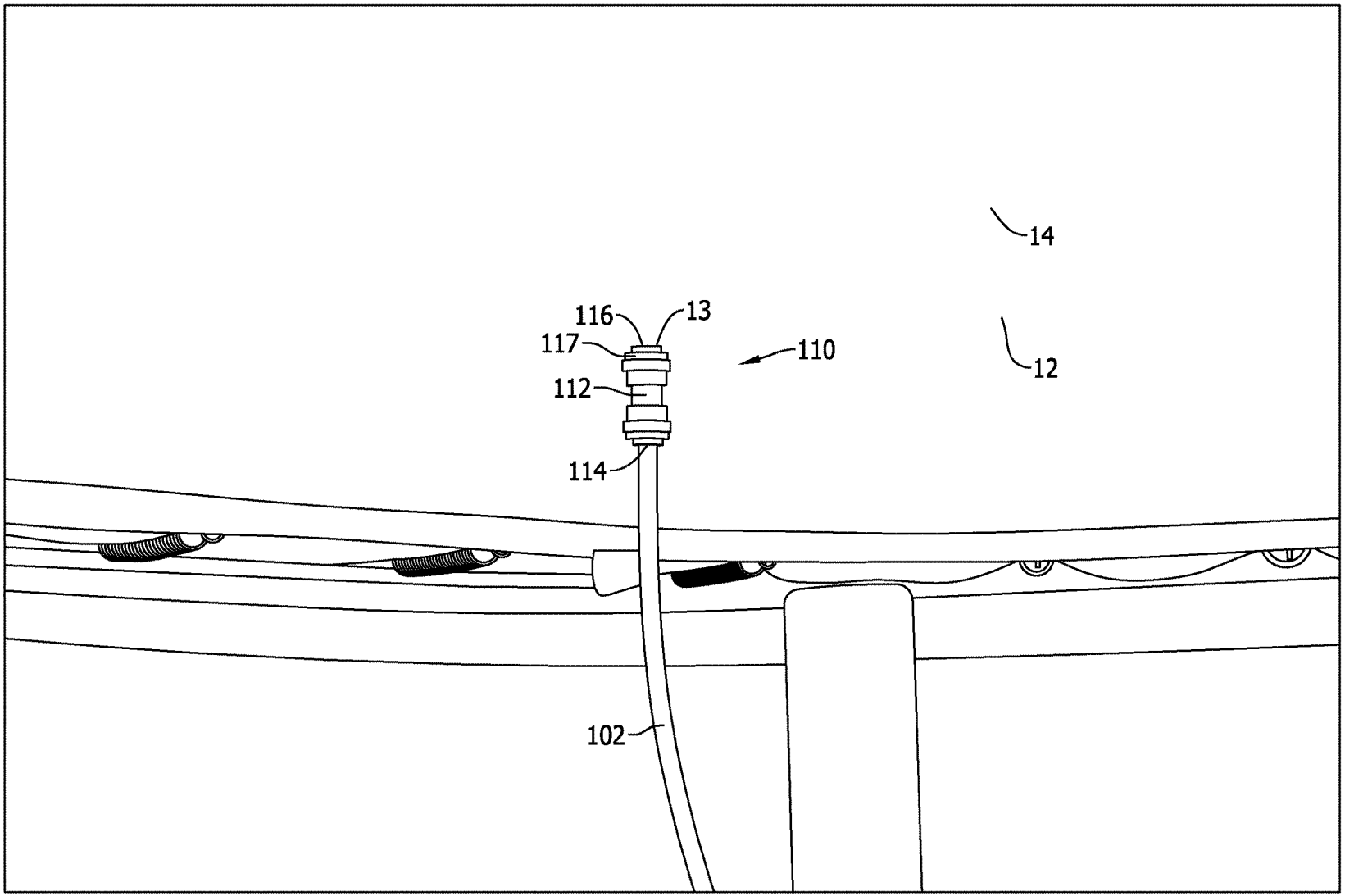
FIG. 2 shows a water sprayer for a trampoline from an underside of a jumping surface, according to one exemplary embodiment.

FIG. 2 shows a water sprayer for a trampoline from an underside of a jumping surface, according to one exemplary embodiment. As shown in FIG. 2, a sprayer 110 is disposed such that it extends through the jumping surface 12 of the trampoline 10. In FIG. 2, the sprayer 110 is shown extending from the bottom side 14 of the jumping surface 12. The sprayer 110 comprises a fitting 112, such as a push fitting, that has a tube connection end 114 and an emitter connection end 117. The tube connection end 114 is configured to receive and lock in the tubing 102 in any conventional manner now known or later developed. For example, the tube connection end 114 may have a push fit connection that holds the tubing 102 in place and seals against the outside of the tubing 102. The emitter connection end 117 is configured to receive an emitter 116 that extends through the jumping surface 12 via a hole 13 in the jumping surface 12.

Figure 3A:
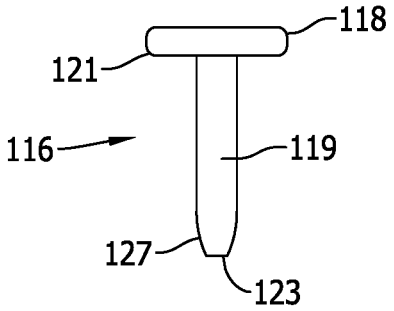
FIGS. 3A, 3B, and 3C show views of an emitter portion, according to an exemplary embodiment.
Figure 3B:
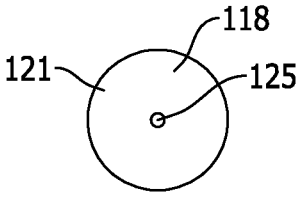
Figure 3C:
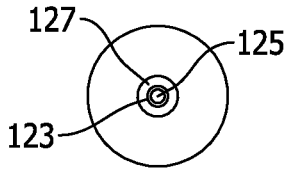

The emitter 116 may be built separately from, and be connectible to, the fitting 112. FIGS. 3A, 3B and 3C show views of an emitter portion, according to an exemplary embodiment. The emitter 116 is built generally with a head 118 and elongated body 119 extending from the head. The head 118 comprises an annular flanged portion 121 having a diameter greater than a diameter of the elongated body 119. A distal end portion 123 of the emitter 116 has a rounded, beveled, or pointed portion 127 that is configured to be inserted into and fit between fibers of the jumping surface 12. In some embodiments, the emitter 116 may be inserted between fibers of the jumping surface 12 using a needle, awl, or similar tool to expand a small hole 13 between the fibers of jumping surface 12. In other embodiments, a hole may be cut out of the jumping surface 12, and the elongated body 119 of the emitter 116 may be inserted into the hole. In some embodiments, the jumping surface 12 may be pre-treated with a heat gun so that the hole 13 may be formed between the fibers of the jumping surface 12 without breaking any of the fibers.

The emitter 116 further comprises a through hole 125 shown in FIGS. 3A and 3B that runs the length of the emitter 116. The through hole 125 is disposed centrally in the elongated body 119 and head 118. The elongated body 119 is formed at a length such that the elongated body 119 fits into the emitter connection end 117 of the fitting 112 while providing sufficient clearance for the jumping surface 12 to fit between the fitting 112 and the head 118 of the emitter 116. In one embodiment, the length of the emitter 116 including the elongated body 119 and head 118 is about one inch. More specifically, the length of the elongated boy portion is between 0.8" and 0.85", and more preferably between 0.81" and 0.83".

The emitter connection end 117 has a width or diameter greater than the elongated body 119 of the emitter 116 to receive the elongated body 119 therein. The combination of the emitter connection end 117 of the fitting 112 and the head 118 of the emitter 116 hold the sprayer 110 in place when extended through the jumping surface 12. That is, the width or diameter of the emitter connection end 117 of the fitting 112 is larger than a hole 13 in the jumping surface 12 through which the elongated body 119 extends. The emitter connection end 117 thus acts as a stopper preventing the sprayer 110 from moving upwards through the hole 13 in the jumping surface 12.

The fitting 112 shown in FIG. 2 has an annular shape. However, the fitting 112 is not limited to such a shape and may be other shapes such as a square, triangle, etc. so long as the width or diameter of the shape at the emitter connection end 117 is sufficiently larger than the hole 13 to prevent upward movement of the sprayer 110. Furthermore, the fitting 112 may be angled, for example, such that that the tube connection end 114 is oriented ninety degrees from the emitter connection end 117. That is, the fitting 112 may have an L-shape or other shape connecting the tube connection end 114 and the emitter connection end 117.

Figure 4:
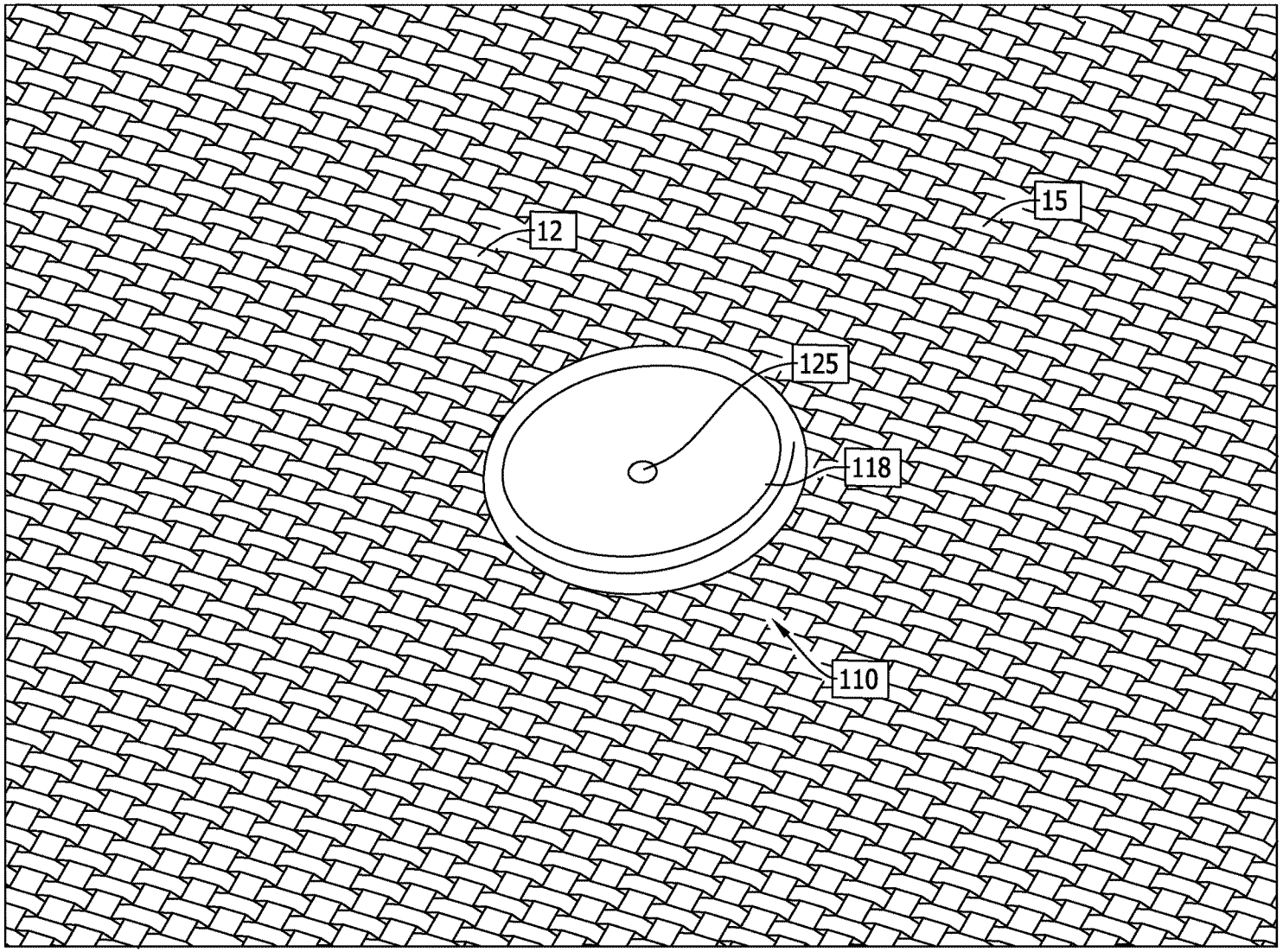
FIG. 4 shows a water sprayer for a trampoline from a top side of a jumping surface, according to one exemplary embodiment.

FIG. 4 shows a water sprayer for a trampoline from a top side of a jumping surface, according to one exemplary embodiment. As shown in FIG. 4, when the emitter 116 is pushed through a hole in the jumping surface 12 to be received in the emitter connection end 117 of the fitting 112, the head 118 is disposed on the top side 15 of the jumping surface 12 of the trampoline 10. Thus, the sprayer 110 extends from the bottom side 14 through the hole 13 to the top side 15 of the jumping surface 12. The head 118 may be configured with any number of emitters having any desired spray pattern. In this embodiment, the through hole 125 acts as a single, central emitter for the sprayer 110. The through hole 125 may be shaped at the head portion 118 to achieve a variety of different spray patterns, as desired.

Figure 5:
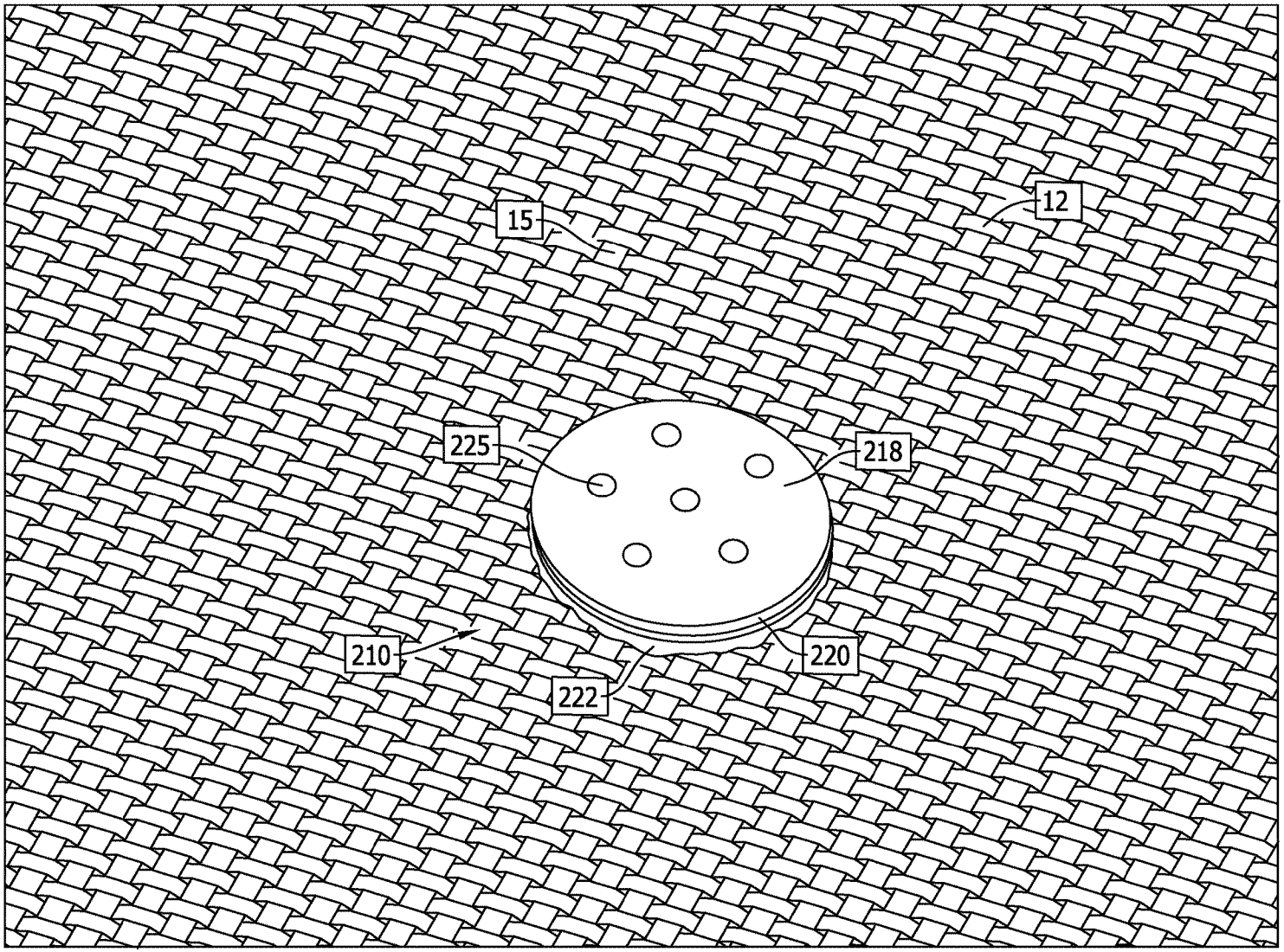
FIG. 5 shows a water sprayer for a trampoline from a top side of a jumping surface, according to an exemplary embodiment.

FIG. 5 shows a water sprayer for a trampoline from a top side of a jumping surface, according to an exemplary embodiment. Here, the head 218 of a sprayer 210 may also include a spacer 220 that rests against the top side 15 of the jumping surface 12 of the trampoline 10. The spacer 220 may provide added support and stability to the sprayer 210. While the spacer 220 is shown on the top side 15 of the jumping surface 12, the spacer may also be placed adjacent to the bottom side 14 of the jumping surface. In some instances, an adhesive 222, such as an epoxy, may adhere the head 218 to the jumping surface 12. This stabilizes the head 218 and prevents the hole 13 in the jumping surface 12 from expanding due to friction and other forces between the jumping surface 12, and the head 218 and the elongated body 119 at the hole 13.

In this embodiment, the head 218 is shown to have a circular shape with a rounded top. The rounded top prevents injury should a person who is jumping on the jumping surface 12 contact the head 218 with her/her foot. Other shapes may be used other than those shown in FIGS. 4 and 5. The material of the emitting portion may be formed from a resilient material to flex and provide cushioning should the foot of person jumping on the jumping surface 12 contact the head 118, 218. A width or diameter of the head 118, 218 is sufficiently larger than the hole 13 so that the sprayer 110, 210 does not fall back through the jumping surface 12.

As stated above, the sprayer 110 may be configured to have a variety of spray patterns based on the shape of the through hole 125 at the head 118. In some embodiments as shown in FIG. 5, a head 218 of a sprayer 210 includes an array of emitters 225 to form more intricate spray patterns. Other arrays of emitters 225 may be used. For example, the head 218 may have a circular array spray pattern. Other patterns may be achieved using a variety of array shapes and hole shapes to achieve spray patterns emitting water to different heights and at different angles.

According to the above embodiments, one or more sprayers may be provided that extend through the jumping surface of the trampoline and emit water from the jumping surface. This provides a unique experience for the user as the water is emitted from the surface on which the jumper is jumping and not from above or from the side as in other applications. Further, because the sprayers extend through the jumping surface, the sprayers move along with the surface as the user jumps on the surface. This has the effect of varying the direction and pattern of the spray as the user jumps, adding to the fun of the sprayers. Further, total water use may be decreased as compared to conventionally placing a sprinkler underneath a trampoline.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A trampoline water spraying system comprising:

one or more sprayers configured to extend through the jumping surface of the trampoline; and tubing connecting the one or more sprayers to a water source, wherein the one or more sprayers comprise:

a fitting having a tube connection end connecting the one or more sprayers to the tubing adjacent to a bottom side of the jumping surface, and an emitter connection end, and an emitter comprising a head disposed on a top side of the jumping surface and an elongated body extending through a hole in the jumping surface, the elongated body being received in the emitter connection end of the fitting.

2. The trampoline water spraying system of claim 1, wherein the one or more sprayers comprises a plurality of sprayers, and the system further comprises junctions connecting tubing to facilitate water flow each of the plurality of sprayers.

3. The trampoline water spraying system of claim 1, further comprising an inlet connection connected to the tubing that attaches to a water source.

4. The trampoline water spraying system of claim 3, wherein the inlet connection is a female garden hose connector.

5. The trampoline water spraying system of claim 3, further comprising a valve in the tubing disposed proximate to the inlet connection, the valve controlling water flow through the tubing.

6. The trampoline water spraying system of claim 1, wherein the emitter connection end is disposed proximate to the bottom side of the jumping surface and has a diameter greater than the hole in the jumping surface to prevent the one or more sprayers from moving upwards toward the top side of the jumping surface.

7. The trampoline water spraying system of claim 6, wherein the emitter connection end has an annular shape.

8. The trampoline water spraying system of claim 1, wherein a through hole extends centrally along the length of the emitter.

9. The trampoline water spraying system of claim 8, further comprising a spacer disposed proximate to the top side or the bottom side of the jumping surface below the head.

10. The trampoline water spraying system of claim 1, further comprising an adhesive adhering the head to the top side of the jumping surface.

11. A sprayer for emitting water onto a trampoline, the sprayer comprising:

a fitting configured to connect to tubing on a bottom side of a jumping surface of the trampoline, and and emitter connected to the fitting and configured to extend through the jumping surface of the trampoline to emit water on a top side of the trampoline wherein the fitting comprises a tube connection end connecting the sprayer to tubing adjacent to the bottom side of the jumping surface, and comprises an emitter connection end; and the emitter comprises a head disposed on the top side of the trampoline and an elongated body extending from the head through a hole in the jumping surface of the trampoline and connecting to the emitter connection end.

12. The sprayer of claim 11, wherein the emitter connection end is disposed proximate to the bottom side of the jumping surface and has a diameter larger than the hole in the jumping surface to prevent the sprayer from moving upwards toward the top side of the jumping surface.

13. The sprayer of claim 12, wherein the emitter connection end comprises an annular shape.

14. The sprayer of claim 11, wherein the emitter comprises a through hole that extends centrally along the length of the emitter.

15. The sprayer of claim 14, further comprising a spacer disposed below the head that is configured to rest on the top side of the jumping surface.

16. The sprayer of claim 11, further comprising an adhesive adhering the head of the emitter to the top side of the jumping surface.

17. The sprayer of claim 11, wherein the fitting comprises an L-shape.

* * * * *